United States Patent [19]

Mendillo

[11] 4,015,762

[45] Apr. 5, 1977

[54] PORTABLE SKI CARRIER

[76] Inventor: Anthony Mendillo, 901 Main St., East Greenwich, R.I. 02818

[22] Filed: Mar. 1, 1976

[21] Appl. No.: 662,843

[52] U.S. Cl. ..... 224/45 S; 294/31.2; 280/11.37 A

[51] Int. Cl.[2] ..... B65D 69/00

[58] Field of Search ..... 294/31.2, 74; 224/45 S, 224/49, 58, 57, 54, 52, 51, 1 A; 24/30.5 R, 81.5 K, 73.5 G, 31 CO, 81 AG; 280/11.37 A

[56] References Cited

UNITED STATES PATENTS

| | | | |
|---|---|---|---|
| 3,768,711 | 10/1973 | Wilkenson | 224/45 S |
| 3,854,640 | 12/1974 | Willmarth | 224/45 S |

FOREIGN PATENTS OR APPLICATIONS

| | | | |
|---|---|---|---|
| 212,444 | 11/1940 | Switzerland | 280/11.37 A |

*Primary Examiner*—James B. Marbert
*Attorney, Agent, or Firm*—Salter & Michaelson

[57] ABSTRACT

A portable device for carrying skis defined by an elongated flexible strap, on one end of which a loop portion is formed, and on the other end of which a hook member is secured. The loop end of the strap is securable about the skis in tightened relation along the length thereof, and the hook end of the strap is securable around the skis in spaced relation with respect to the loop end, the length of the strap extending between the secured loop and hook ends defining a carry portion for portably transporting the skis.

4 Claims, 7 Drawing Figures

PORTABLE SKI CARRIER

BACKGROUND OF THE INVENTION

The present invention relates to a device that is securable around skis and accessory articles, such as ski poles, for transporting the skis and articles when they are not in use.

Many forms of ski carriers of the portable variety have been used heretofore; but all of the prior known devices employed for this purpose have normally incorporated various hooks and straps and other parts, such as buckles and belts, that were fairly complicated in construction and were not only difficult to assemble in the use thereof, but were so bulky that the storing of such a ski carrier, when the skis were in use, was not practical. Further, since the prior known portable ski carriers were somewhat cumbersome, they required special care in the mounting of the skis thereon or in the attachment of the carrier to the skis for the transporting thereof. Because the prior known ski carriers were somewhat complicated in construction and use, the cost therefor was in excess of the amount considered to be reasonable for a portable carrier by the ordinary skier.

SUMMARY OF THE INVENTION

The portable carrier embodied in the present invention has particular application for carrying skis and accessory articles therefor when not in use; and comprises an elongated, flexible strap, on one end of which a loop is formed, and on the other end of which a hook is secured. In use of the device, the loop end of the strap is secured around the skis in tightened relation on one side of the bindings thereof. The hook end of the strap is then secured around the skis in spaced relation with respect to the loop end and on the other side of the bindings, wherein the skis are balanced when lifted by the carrier; and the length of the strap extending between the secured loop and hook ends defining a carry portion for portably transporting the skis in balanced relation. By winding the hook end of the strap several times around the skis, the intermediate length thereof is reduced; and when the hook end is secured to the strap, the reduced length of strap defines a handcarry for transporting the skis.

Accordingly, it is an object of the present invention to provide a simple but effective portable device for carrying skis that essentially comprises an elongated, flexible strap, the ends of which are secured around the skis in spaced relation, the intermediate portion of the strap defining a carry portion for transporting the skis.

DESCRIPTION OF THE DRAWINGS

In the drawings which illustrate the best mode presently contemplated for carrying out the present invention.

DESCRIPTION OF THE INVENTION

Figure 2:
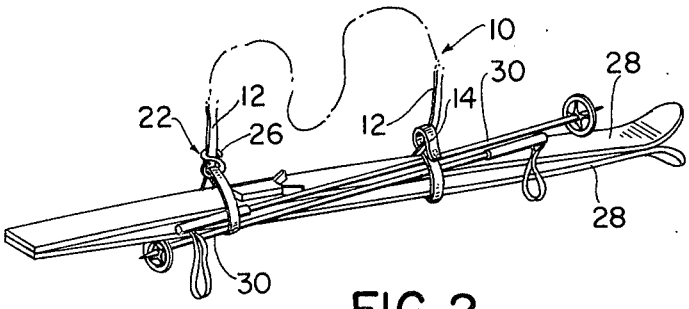
FIG. 2 is a perspective view showing the flexible strap that comprises the ski carrier of the present invention.
Figure 1:
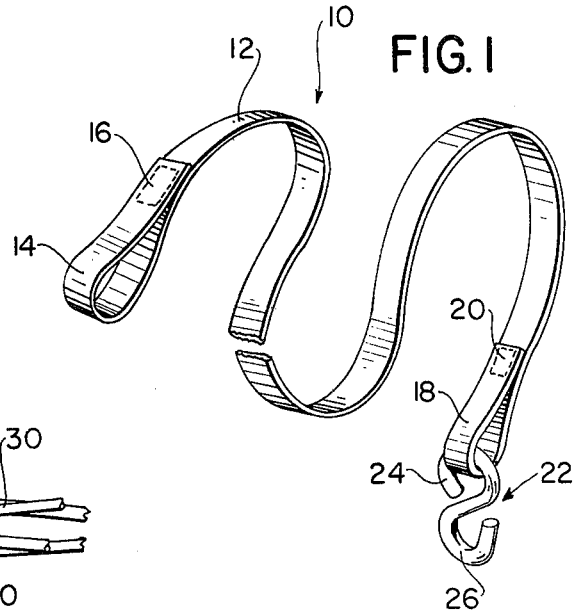
FIG. 1 is a perspective view showing a pair of skis and ski poles that are secured in carrying position by the ski carrier of the present invention.

Referring now to the drawing and particularly to FIG. 1, the portable ski carrier as embodied in the present invention is illustrated and is generally indicated at 10. As shown in FIG. 2, the ski carrier 10 has particular application in the portable transporting of skis; although it is also contemplated that other ski accessories, such as ski poles, will be carried along with the skis by the ski carrier of the subject invention. Hereinafter, the description as set forth will refer to the use of the ski carrier 10 in connection with skis, although it is understood that this is intended to convey that other accessory articles, such as ski poles, may also be carried therewith.

Referring again to FIG. 1, the portable ski carrier as shown comprises essentially an elongated, flexible strap 12. The flexible strap 12 may be formed of any suitable material, such as nylon or other woven plastic or non-plastic material, or the strap may be formed of an extruded plastic material or of a cloth, and the like. The only requirement for the material from which the strap 12 is formed is that it be relatively durable and that it be sufficiently flexible to enable it to be utilized in the manner as will be set forth hereinafter.

Located on one end of the strap 12 is a loop 14 that defines a loop portion and that is formed by bending over a free end of the strap for securement at 16 to the body of the strap by stitching, heat sealing, or any other suitable securing technique. The size of the opening as defined by the loop 14 is determined by the size of the hook mounted on the opposite end of the strap 12, as will be described.

The end of the strap 12 opposite to the loop 14 is also formed with a loop 18 by bending the free end of the strap and securing it to the body thereof at 20. Fixed in the loop 18 for permanent securement thereto is an "S"-shaped hook generally indicated at 22, having an end portion 24 that is bent to a closed position so as to permanently mount the hook 22 on the loop 18. Formed oppositely of the hook portion 24 is a hook portion 26, the end of which is open relative to the adjacent portion of the hook, thereby enabling the hook portion 26 to be slidably received on the strap 12, as will hereinafter be described.

Figure 3:
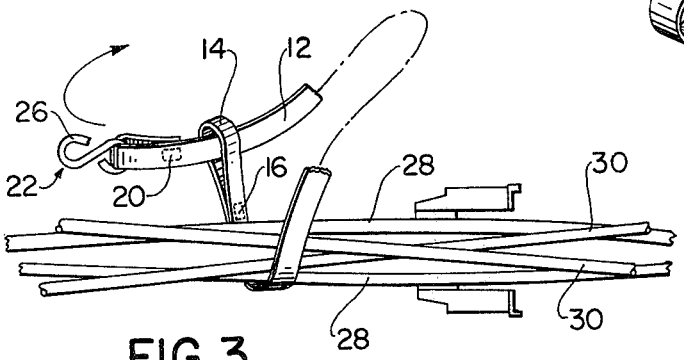
FIG. 3 illustrates the first step in locating the loop end of the strap around the skis when the device is to be used as a carrier therefor.
Figure 4:
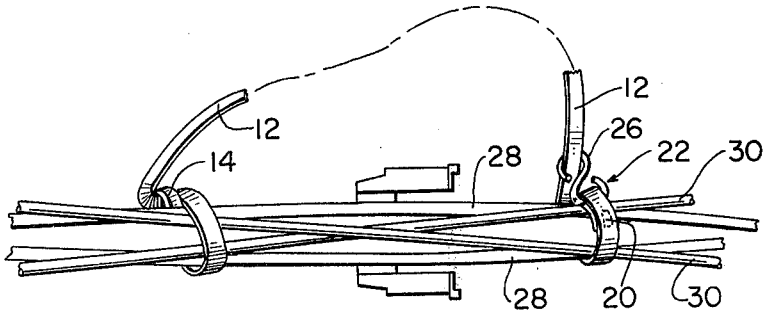
FIG. 4 illustrates the position of the hook end of the strap after it has been fastened in place, the strap as illustrated defining a shoulder carry for the skis.
Figure 7:
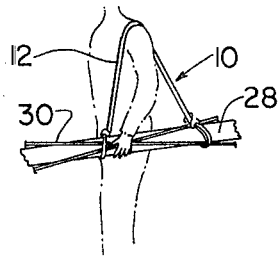
FIG. 7 is a view illustrating the location of the ski carrier on the shoulder of a user when the strap has been mounted on the skis in the manner as shown in FIG. 4.

In the securement of the carrier 10 to the skis 28, the loop end 14 is placed around the skis on one side of the bindings thereof as illustrated in FIG. 3, after which the hook 22 is threaded through the loop 14 and pulled therethrough until the loop end tightly engages the skis as shown in FIG. 4. The hook end is then wrapped around the opposite ends of the skis 28 on the other side of the bindings and in spaced relation relative to the loop end. Assuming that the carrier is to be utilized for a shoulder carrier as illustrated in FIG. 7, the hook 22 is then engaged with the strap 12 by threading the strap 12 through the open hook portion 26, as also illustrated in FIG. 4. Since the hook portion 26 defines a bearing surface for the strap 12, the strap 12 is tightened by pulling upwardly relative to the hook 22, the loop end and hook end cooperating to firmly secure the skis together, the intermediate portion of the strap defining a convenient handle portion for lifting and carrying the skis.

It is seen that after the hook 22 has been placed through the loop 14 and the strap 12 pulled tightly to bind the hook end 14 around the skis on one side of the bindings as shown in FIG. 4, the hook end of the strap is moved along the length of the skis to the opposite side of the bindings and is then wound around the skis as shown in FIG. 4. Since the strap is threaded through the open hook portion 26, the open hook portion 26 as it engages the strap 12 defines a bearing surface therefor, and pulling of the strap relative to the hook end causes the hook end to tightly bind around the skis in close fitting relation. Pulling upwardly on the strap then causes both the loop end and the hook end as fitted around the skis to be more tightly secured therearound, and the strap can then be placed over the shoulder of the user as illustrated in FIG. 7, and the skis carried conveniently in this manner. Since the strap 12 is fixed around the skis on opposite sides of the bindings, the skis are appropriately balanced when lifted by the carry portion of the strap.

Figure 6:
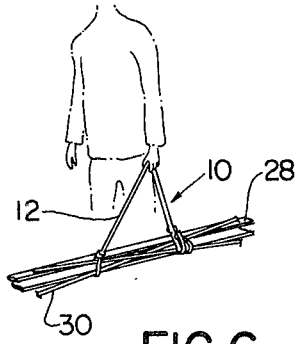
FIG. 6 is a perspective view showing the manner in which the skis are hand carried when the strap of the present invention is located in the position illustrated in FIG. 5.
Figure 5:
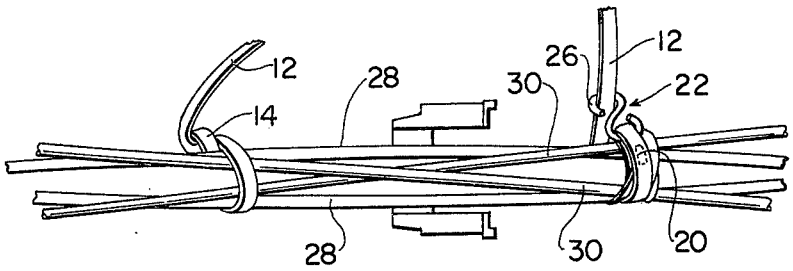
FIG. 5 is a view similar to FIG. 4 and illustrating the manner in which the hook end of the strap has been wound several times around the skis to reduce the length of the intermediate portion of the strap so as to define a hand-carry.

If it is desired to hand carry the skis in the manner as illustrated in FIG. 6, the hook end of the strap after it has been threaded through the loop 14 is wound several turns around the skis as shown in FIG. 5. The hook portion 26 of the hook 22 is again threaded onto the strap 12 as shown in FIG. 5 to secure the hook end thereto. As the intermediate portion of the strap is pulled upwardly, the wound portions on the loop and hook ends tightly engage the skis; and since the intermediate portion of the strap has been reduced in length, the carrier can then be used as a hand-carrier, as illustrated in FIG. 6.

It is seen that the portable ski carrier 10 may be quickly and simply applied to the skis or poles used therewith without the use of any complicated buckles, straps or connector devices and, in a matter of seconds, is placed in position for either carrying the skis on the shoulder of the user as illustrated in FIG. 7 or for hand carrying as illustrated in FIG. 6. When the skis are to be used, the ski carrier 10 is quickly and simply removed from the carry position; and because of the flexible characteristics thereof, the carrier can be conveniently placed in a pocket of the user without adding any undue bulk thereto. In this connection, the user need not find a storage place for the carrier, since it is always retained on his person; and whenever it is necessary to utilize the carrier, it is conveniently available and can be mounted on the skis in a matter of seconds.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A portable device for carrying skis, comprising an elongated flexible strap, on one end of which a loop is formed and on the other end of which a hook is secured, said strap being unencumbered along the length thereof and the loop end of said strap being wrapped around an end of said skis and receiving the remaining portion of said strap therethrough, wherein said remaining portion is pulled in tightened relation on one side of the bindings of said skis to lock said loop end around the end of said skis, the hook end of said strap being wrapped around the other end of said skis to leave said hook exposed, the portion of said strap adjacent to said hook being received therein and pulled relative thereto to lock said strap in tightened relation on the other side of said bindings, wherein said loop and hook ends are located in spaced relation relative to each other, the length of said strap extending between the secured loop and hook ends defining a carry portion for portably transporting said skis.

2. A portable device as claimed in claim 1, the length of the carry portion of said strap being adjusted by varying the number of turns the hook end of said strap is wrapped around said skis.

3. A portable device as claimed in claim 2, said skis being disposed in bottom-to-bottom relation so that the securement of said strap therearound on opposite sides of the bindings thereof locks said skis together so that the skis are balanced when lifted by the carrier.

4. A portable device as claimed in claim 1, said hook end including a hook member that is formed in an "S" configuration, one end of said hook member receiving an end of said strap in engaging relation for permanently mounting said strap thereon, the other end of said hook member being open for receiving said strap therein, wherein said other end provides a bearing surface for the strap to enable the hook end of the strap to be securable around said skis in tightened relation.

* * * * *